US005114381A

United States Patent [19]

Ueda et al.

[11] Patent Number: 5,114,381

[45] Date of Patent: May 19, 1992

[54] COIN FEEDING APPARATUS FOR COIN HANDLING MACHINE

[75] Inventors: Nobuo Ueda, Sakae; Tatuo Okita, Itami; Mikio Suzuki, Izumi; Yasunori Ikemoto; Hiloyuki Shibao, both of Osaka, all of Japan

[73] Assignee: Laurel Bank Machines Co., Ltd., Tokyo, Japan

[21] Appl. No.: 665,579

[22] Filed: Mar. 6, 1991

[30] Foreign Application Priority Data

Mar. 14, 1990 [JP] Japan ..... 63588

[51] Int. Cl.[5] ..... G07D 1/00

[52] U.S. Cl. ..... 453/57; 453/49; 453/56

[58] Field of Search ..... 453/7, 11, 49, 56, 57; 221/203

[56] References Cited

U.S. PATENT DOCUMENTS 3,795,253 3/1974 Hatanaka et al. ..... 453/57
4,173,232 11/1979 Asami et al. ..... 453/57
4,657,035 4/1987 Zimmermann .
4,904,223 2/1990 Sentoku ..... 453/7
4,997,406 3/1991 Horiguchi et al. ..... 453/57
5,015,214 5/1991 Suzuki ..... 453/56

FOREIGN PATENT DOCUMENTS 2223873 4/1990 United Kingdom .
2225472 5/1990 United Kingdom .

*Primary Examiner*—Robert J. Spar
*Assistant Examiner*—Scott L. Lowe
*Attorney, Agent, or Firm*—Fleit, Jacobson, Cohn, Price, Holman & Stern

[57] ABSTRACT

A coin feeding apparatus for a coin handling machine of the rotatable disk kind includes a guide extending along the coin flow path in the vicinity of an opening of a guide ring. The guide is swingable between a first position where its face is smoothly aligned with the inner circumference of the guide ring and a second position where the face is not smoothly aligned. The guide means, when disposed in its second position, acts to prevent the jamming of coins when the coins are driven in a reverse direction back through the opening onto the rotatable disk.

6 Claims, 4 Drawing Sheets

COIN FEEDING APPARATUS FOR COIN HANDLING MACHINE

CROSS REFERENCE TO RELATED APPLICATION

The present invention relates generally to the subject matter of the following prior U.S. patent application: Ser. No. 07/402,640, filed on Sept. 5, 1989, now U.S. Pat. No. 5,015,214 entitled "Coin Feed-in Apparatus for Coin Handling Machine".

BACKGROUND OF THE INVENTION

The present invention relates to a coin feeding apparatus for a coin handling machine in which a rotatable disk for receiving coins is provided and coins are fed one by one by centrifugal force produced by the rotation of the rotatable disk into a coin passage where the discrimination of their denominations, whether or not they are acceptable and the like and the counting of their value in accordance with their denominations are carried out.

DESCRIPTION OF THE PRIOR ART

There is known a coin handling machine having a rotatable disk for receiving coins, in which coins are fed to a coin passage one by one by centrifugal force produced by the rotation of the rotatable disk to be fed along one of a pair of guide rails and in which a discriminating means and counting means are provided, whereby the discrimination of their denominations, whether or not they are acceptable and the like and the counting of the value of deposited coins in accordance with their denominations are carried out. For making this kind of coin handling machines compact, it is preferable to feed the coins along the inner guide rail of the pair of guide rails, that is, disposed on the side of the rotatable disk.

For example, Japanese Laid-Open Utility Model Application No. 59(1984)-165064 proposes a coin feeding apparatus for a coin handling machine which feeds coins along the inner guide rail of the pair of guide rails. This coin feeding apparatus comprises a guide ring disposed so that its inner circumference for guiding coins is disposed outside of the periphery of the rotatable disk and having an opening for feeding out coins to a coin passage, a pair of guide rails for guiding coins being fed in the coin passage, a transporting belt above the coin passage for pressing coins onto the upper face of the coin passage and feeding them along inner guide rail, and a guide roller disposed upstream of the inner guide rail and rotatable so as to prevent coins from jamming and feeding them into the coin passage.

However, in the thus constituted coin feeding apparatus, a coin fed from the rotatable disk into the coin passage first comes into contact with the guide roller. However, since the guide roller is not rotated, the coin is inevitably temporarily stopped when it comes into contact with the guide roller and the following coin often collides with it. Therefore, there is a risk of the preceding coin and/or the following coin being push away from the inner guide rail, along which they should be fed, toward the outer guide rail. Although the transporting belt is driven so as to feed the coins along the inner guide rail as described above, when such a deviation occurs, it is difficult for the transporting belt to return the coins to their desired transporting path and feed the coins along the inner guide rail and is also difficult to carry out the discrimination and counting of their value by the discriminating means and the counting means arranged along the inner guide rail in a desired manner. Particularly, where the difference in diameter between the largest diameter coins and the smallest diameter coins is great, or where the difference in thickness between the thickest coins and the thinnest coins is great, the smallest coins or the thinnest coins tend to deviate from their desired transporting path owing to the type of collision mentioned above and the problem becomes serious.

Further, in this kind of coin feeding apparatus, when the discriminating means detects an unacceptable coin such as a counterfeit coin, a foreign coin or the like, the transportation of coins is stopped and the unacceptable coin is manually removed from the coin passage after opening the coin feeding apparatus. However, during the removal of the unacceptable coin, the following coins fed successively into the coin passage after the unacceptable coin often deviate from the position along the inner guide rail and in such case, there is a risk that the discrimination and counting of the value of deposited coins by the discriminating means and the counting means arranged along the inner guide rail cannot be carried out in a desired manner. Therefore, after removing the unacceptable coin, the ordinary practice is to drive the transporting belt in the reverse direction and reversely rotate the rotatable disk for returning the following coins fed into the coin passage onto the rotatable disk. Then the feed of coins is restarted.

However, in this kind of the coin feeding apparatus, since the positional relationship between the terminal portion of the guide ring and the guide roller is determined so as to be close for ensuring that all coins to be handled come into contact with the guide roller without fail and are fed in the coin passage along the inner guide rail, when the following coins successively fed into the coin passage after the unacceptable coin are returned onto the rotatable disk, they collide with the terminal portion of the guide ring, whereby it is difficult to smoothly return them onto the rotatable disk and coin jamming may occur, whereby the following coins have to be manually removed and there arises a problem that it is difficult to restart the coin feeding operation.

SUMMARY OF THE INVENTION

It is, therefore, an object of the present invention to provide a coin feeding apparatus for a coin handling machine, which can prevent coins from being erroneously discriminated and the value of coins from being erroneously counted and easily restart the coin feeding operation even when an unacceptable coin is detected.

According to the present invention, the above and other objects can be accomplished by a coin feeding apparatus for a coin handling machine comprising a rotatable disk for receiving coins, guide ring means having a circular inner circumference disposed inside of the outer periphery of the rotatable disk and an opening for guiding by the inner circumference thereof coins received by the rotatable disk and moved toward the outer periphery of the rotatable disk by centrifugal force produced by the rotation of the rotatable disk, a coin passage communicating with said opening and having a pair of first and second guide rail means and transporting belt means for transporting coins, the coins being transported along the first guide rail means disposed on the side of the rotatable disk of the pair of guide rail means, discriminating means for discriminating the denomination of coins, whether or not the coins are acceptable and the like, counting means for counting the value of deposited coins, the discriminating means and the counting means being arranged along the first guide rail means of said coin passage, and rotatable guide roller means disposed upstream of said first guide rail means, the first guide rail means extending onto the rotatable disk, said coin feeding apparatus for a coin handling machine further comprising guide means extending downstream with respect to the coin feeding direction from a portion in the vicinity of a terminal portion of said guide ring means and swingable between a first position where its face on the side of the rotatable disk is smoothly aligned with the inner circumference of said guide ring means and a second position where said face on the side of the rotatable disk is apart from said guide roller means, the distance between a corner portion of the terminal portion of the guide means closest to the guide roller means and a tangential plane of the guide roller means lying parallel with a face of the first guide rail means on the side of the coin passage being smaller than the smallest diameter of coins to be handled and the distance between said corner portion of the terminal portion of the guide means closest to the guide roller means and the outer circumference of said guide roller means being slightly greater than the largest diameter of coins to be handled when the guide means is positioned at the first position, the distance between the corner portion of the terminal portion of the guide means closest to the guide roller means and the tangential plane of the guide roller means lying parallel with a face of the first guide rail means on the side of the coin passage being greater than the largest diameter of coins t be handled when the guide means is positioned at the second position.

In a preferred aspect of the present invention, the upstream end of the transporting belt means is further disposed upstream of the opening and of the terminal portion of the guide means with respect to the rotating direction of the rotatable disk.

In a further preferred aspect of the present invention, coin separation means is further provided upstream of the opening and such that the clearance between itself and the upper face of the rotatable disk is slightly greater than the thickness of the thickest coins t be handled and smaller than double the thickness of the thinnest coins to be handled, and an upstream corner portion of the guide means projects from the vicinity of the upstream end of the coin separation means onto the rotatable disk inside of the coin separation means when the guide means is disposed at its second position.

DESCRIPTION OF THE PREFERRED EMBODIMENTS

Figure 1:
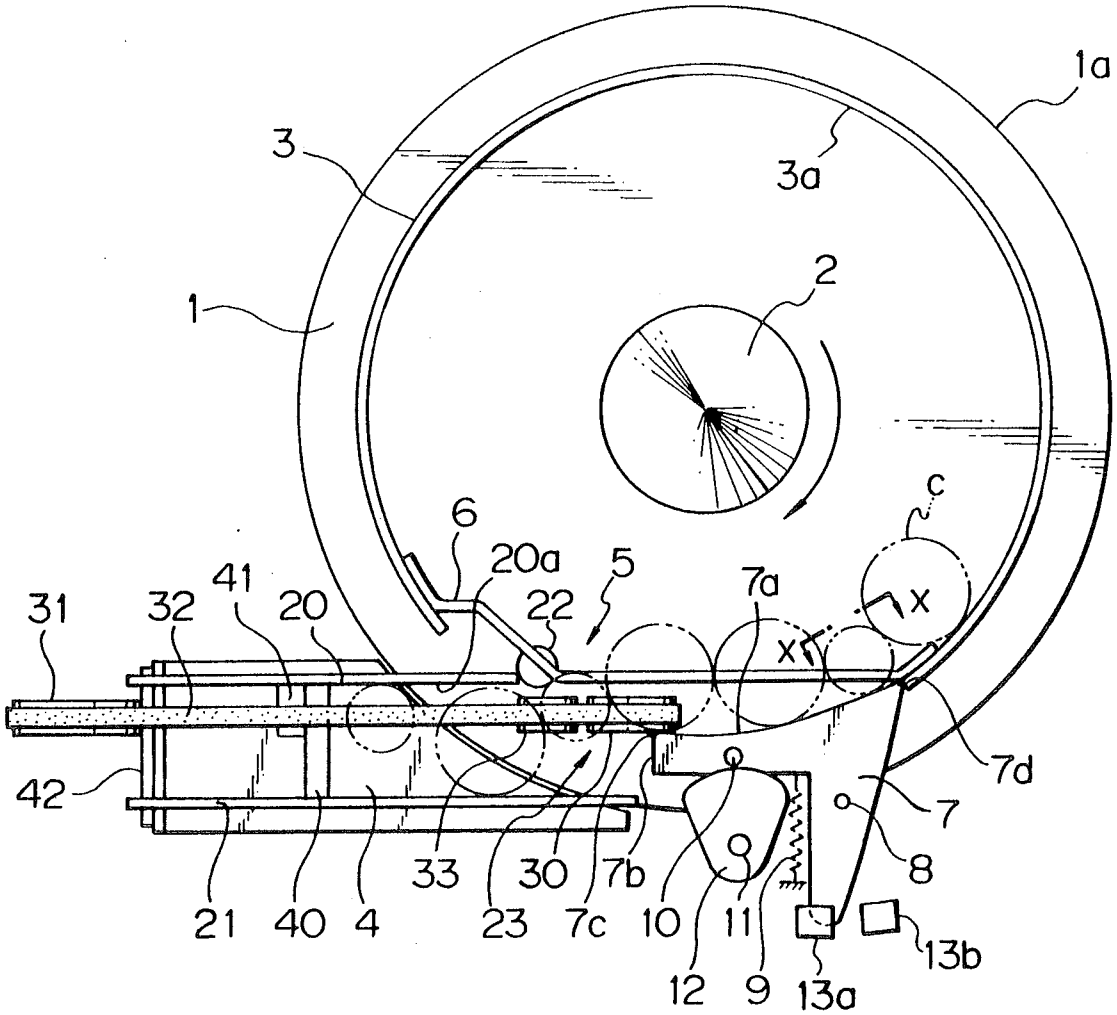
FIG. 1 is a schematic drawing showing a plan view of a coin feeding apparatus for a coin handling machine which is an embodiment of the present invention.

Referring to FIG. 1, a rotatable disk 1 for receiving coins C deposited through a coin deposit opening (not shown) is mounted on a base (not shown) so as to be rotatable clockwise in FIG. 1 about a shaft 2 by a drive means (not shown).

A guide ring member 3 disposed above the rotatable disk 1 is fixed to the body of a coin handling machine by a bracket (not shown). The inner circumference 3*a* of the guide ring member 3 is circular and is disposed inside of the periphery 1*a* of the rotatable disk 1. The clearance between the lower face of the guide ring means 3 and the upper face of the rotatable disk 1 is set smaller than the thickness of the thinnest coins to be handled.

A part of the guide ring member 3 is formed with an opening 5 communicating with a coin passage 4 and a coin separation plate 6 is provided above the rotatable disk 1 to extend over the entire area of the opening 5.

Figure 2:
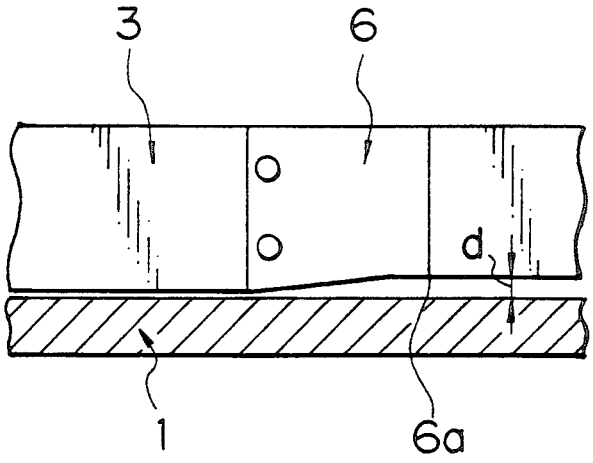
FIG. 2 is a schematic drawing showing a cross sectional view taken on line X—X of FIG. 1.

FIG. 2 is a schematic drawing showing a cross sectional view taken on line X-X of FIG. 1. As shown in FIG. 2, the coin separation plate 6 is secured to the end portion of the guide ring member 3 and the clearance between its lower edge and the upper face of the rotatable disk 1 is set so as to gradually increase from a portion where it is secured to the guide ring member 3 downstream with respect to the coin feed direction and to have a predetermined height "d" which is slightly greater than the thickness of the thickest coins to be handled and smaller than double the thickness of the thinnest coins to be handled downstream of a predetermined position 6*a* with respect to the coin feed direction. Since the clearance between the coin separation plate 6 and the upper face of the rotatable disk 1 is defined in this manner, the coins fed out from the rotatable disk 1 into the coin passage 4 are separated one by one by the coin separation plate 6.

Further, there is provided a guide member 7 extending from the vicinity of the terminal portion of the guide ring member 3 downstream with respect to the coin feed direction. The guide member 7 is substantially "L" shaped and is mounted swingably about a shaft 8. One end of a spring 9 having its other end fixed to the body of the coin handling machine is fixed to the guide member 7, whereby the guide member 7 is biased counterclockwise. A rotatable cam follower 10 is formed on the upper face of the guide member 7 and abuts against a cam 12 rotatable about a cam shaft 11. When the cam follower 10 is in contact with the cam lobe farthest from the cam shaft 11 of the cam 12, the guide member 7 is disposed at its first position so that its inner face 7*a* on the side of the rotatable disk 1 is smoothly aligned with the inner circumference 3*a* of the guide ring member 3 and its upstream corner portion 7*d* is disposed in the region downstream of the predetermined position 6*a* where the clearance between the lower edge of the coin separation plate 6 and the upper face of the rotatable disk 1 equals "d" and the coins are fed from the rotatable disk 1 into the coin passage 4, while the guide member 7 is disposed at its first position. FIG. 1 shows the guide member 7 disposed at its first position.

Figure 3:
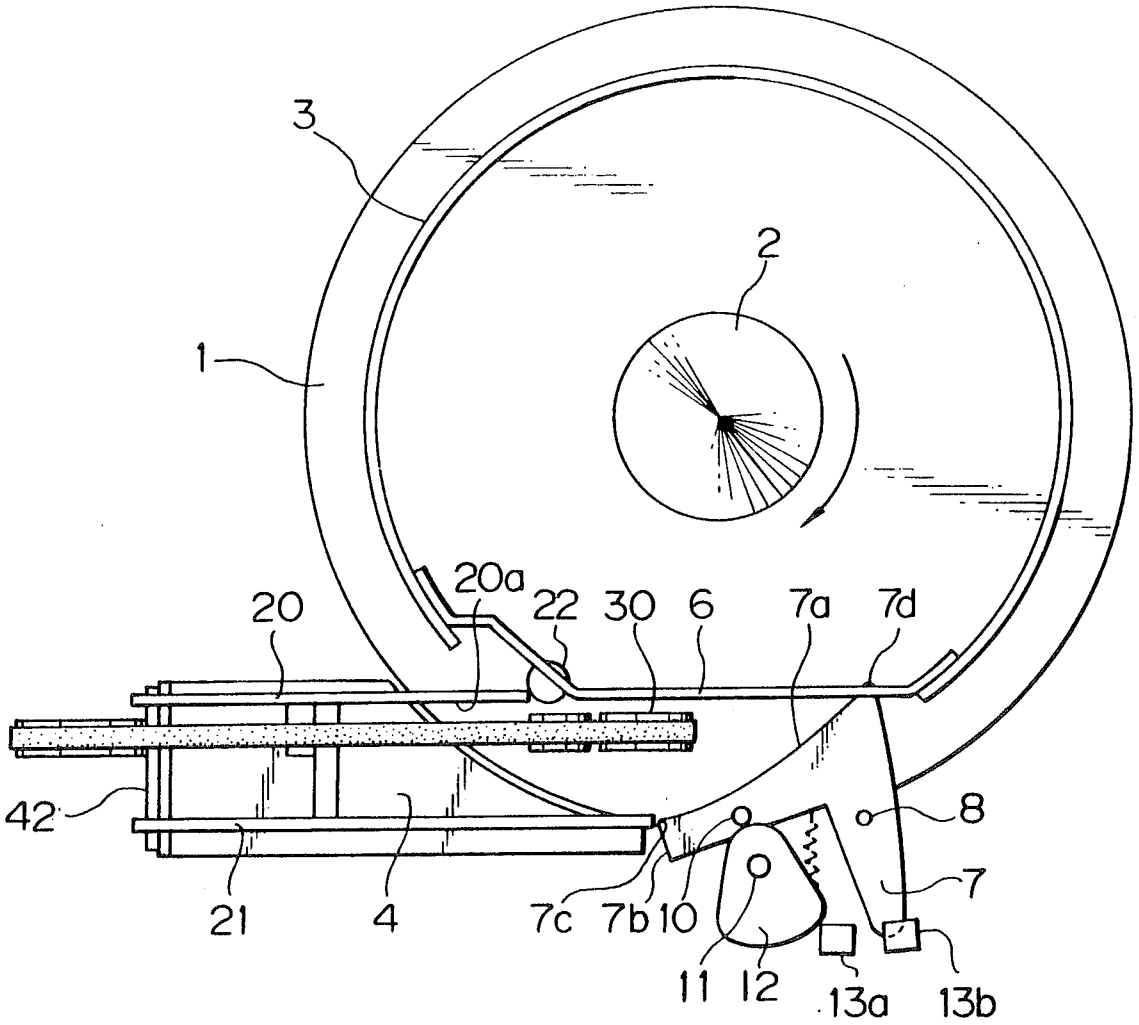
FIG. 3 is a schematic drawing showing a plan view of a coin feeding apparatus for a coin handling machine which is an embodiment of the present invention, in the state where an unacceptable coin is being returned onto the rotatable disk.

On the other hand, as shown in FIG. 3, when the cam follower 10 is in contact with the cam lobe nearest to the cam shaft 11 of the cam 12, the guide member 7 is disposed at its second position so that its terminal portion 7*b* is farthest from the shaft 2 of the rotatable disk 1 and its upstream corner portion 7*d* projects from the region downstream of the predetermined position 6*a* where the clearance between the lower edge of the coin separation plate 6 and the upper face of the rotatable disk 1 equals "d" onto the rotatable disk 1 inside of the coin separation plate 6. After an unacceptable coin has been removed, the following coins are returned from the coin passage 4 onto the rotatable disk 1 with the guide member 7 disposed at its second position. Therefore, the thickness of the guide member 7 is determined smaller than the value "d".

The rotation of the cam 12 is controlled to dispose the guide member 7 at its first position or at its second position as detected by a first sensor 13*a* and a second sensor 13*b*.

Accordingly, the coins C received by the rotatable disk 1 are fed toward the opening 5 of the guide ring member 3 by centrifugal force produced by the rotation of the rotatable disk 1, while being guided by the inner circumference 3*a* of the guide ring member 3, and separated one by one to be fed one by one toward the guide member 7 which is disposed at its first position and further fed into the coin passage 4, while being guided by the inner face 7*a* of the guide member 7.

A pair of first and second guide rails 20, 21 are provided in the coin passage 4 and the first guide rail 20 disposed inside, that is, on the side of the rotatable disk 1, extends to inside of the periphery 1*a* of the rotatable disk 1. The pair of first and second guide rails 20, 21 are arranged to be substantially parallel with the part of the inner face 7*a* near the terminal portion of the guide member 7 when the guide member 7 is disposed at its first position and the clearance between the lower faces of the first and second guide rails 20, 21 and the upper faces of the rotatable disk 1 and the coin passage 4 is determined smaller than the thickness of the thinnest coins C to be handled. A rotatable guide roller 22 is provided in the vicinity of the upstream end portion of the first guide rail 20 with respect to the coin feed direction. A coin feed-out opening 23 is formed between the periphery of the guide roller 22 and the corner portion 7*c* of the terminal portion 7*b* of the guide member 7, which is closest to the guide roller 22. Where the coins C are fed into the coin passage 4, the guide member 7 is disposed at its first position, whereby the distance between the periphery of the guide roller 22 and the corner portion 7*c* of the guide member 7 is slightly greater than the diameter of the largest coins C to be handled and the distance between the tangential plane of the guide roller 22 lying parallel with the face 20*a* of the first guide rail 20 on the side of the coin passage 4, and the corner portion 7*c* of the guide member 7 is slightly smaller than the diameter of the smallest coins C to be handled. This ensures that all coins C to be handled can be fed out through the coin feedout opening 23 and that all the coins C fed out can abut against the guide roller 22 without fail. On the other hand, where the guide member 7 is disposed at its second position, the distance between the tangential plane of the guide roller 22 lying parallel with the face 20*a* of the first guide rail 20 on the side of the coin passage 4, and the corner portion 7*c* of the guide member 7 is set greater than the diameter of the largest coins C to be handled. Further, the clearance between the lower face of the guide roller 22 and the upper face of the rotatable disk 1 is set smaller than the thickness of the thinnest coins C to be handled.

A endless transporting belt 32 engaged with a first pulley 30 and a second pulley 31 able to be driven by a drive means (not shown) extends in parallel with the pair of first and second guide rails 20, 21 from the upstream of the terminal portion 7*b* of the guide member 7 to the coin passage 4 and is adapted to transport the coins C fed along the inner circumference 7*a* of the guide member 7 in the direction parallel with the pair of first and second guide rails 20, 21. As described above, since the distance between the tangential plane of the guide roller 22 lying parallel with the face 20*a* of the first guide rail 20 on the side of the coin passage 4, and the corner portion 7*c* of the guide member 7 is set slightly smaller than the diameter of the smallest coins C to be handled, all the coins C transported by the transporting belt 32 are fed into the coin passage 4 so that they can come into abutment against the guide roller 22 without fail and the coins C are transported along the face 20*a* of the first guide rail 20 on the side of the coin passage 4.

Further, a press roller 33 is provided downstream of the first pulley 30 and slightly upstream of the guide roller 22 and presses the transporting belt 32 downwardly. Since the press roller 33 is provided in this manner, the transporting belt can press the coins C downwardly with a force of sufficient magnitude, even though the first pulley 30 engaged with the transporting belt 32 is disposed only slightly upstream of the terminal portion 7*b* of the guide member 7.

The upper face of the coin passage 4 is set at the same level as the rotatable disk 1. Further, a sensor array 40 for detecting the diameter of coins C and a magnetic sensor 41 for detecting magnetic properties of coins C are provided along the face 20*a* of the first guide rail 20 on the side of the coin passage 4 and detection signals detected by these sensors are input into a control unit (not shown). Based upon the coin diameter detected by the sensor array 40 and the magnetic properties detected by the magnetic sensor 41, the control unit discriminates the denominations of coins C and whether or not the coins C is acceptable, counts the value of the deposited coins C in accordance with their denominations and, when it detects an unacceptable coin, displays information to this effect on a display means (not shown).

A substantially rectangular stopper 42 is provided in the coin passage 4 downstream of the sensor array 40 and the magnetic sensor 41. The upper edge of the stopper 42 is normally positioned below the upper face of the coin passage 4 and is caused to project above the upper face of the coin passage 4 by a stopper drive means (not shown) when the control unit judges based upon the input signals from the sensor array 40 and the magnetic sensor 41 that the coin C is unacceptable, thereby to stop the transportation of the unacceptable coin C. When an unacceptable coin C is detected and is prevented from being transported by the stopper 42, the control unit causes the display means (not shown) to display information to this effect. As a result, after the unacceptable coin C detected has been removed by an operator, a motor (not shown) is driven by the control unit so that the transporting belt 32 is reversely moved and the rotatable disk 1 is rotated counterclockwise, whereby the following coins C which have been successively fed into the coin passage 4 after the unacceptable coin C was stopped by the stopper 42 are returned onto the rotatable disk 1. At this time, the guide member 7 is swung to its second position and the distance between the corner portion 7*c* of the terminal portion 7*b* of the guide member 7 and the tangential plane of the guide roller 22 lying parallel with the face 20*a* of the first guide rail 20 on the side of the coin passage 4 is set greater than the diameter of the largest coins C to be handled, whereby the following coins C can be smoothly returned onto the rotatable disk 1 without colliding with the terminal portion 7*b* of the guide member 7. Further, as shown in FIG. 3, since the upstream corner portion 7 *d* of the guide member 7 is positioned so as to project in the region downstream of the predetermined position 6*a* where the clearance between the lower edge of the coin separation plate 6 and the upper face of the rotatable disk 1 equals "d", the following coins C are prevented from being fed toward a portion between a portion where the coin separation plate 6 is mounted on the guide ring member 3 and the predetermined portion 6*a* of the coin separation plate 6, where the clearance is smaller than "d" and, therefore, the following coins C are smoothly returned onto the rotatable disk 1 through the clearance between the lower edge of the coin separation plate 6 and the upper face of the rotatable disk 1.

Figure 4:
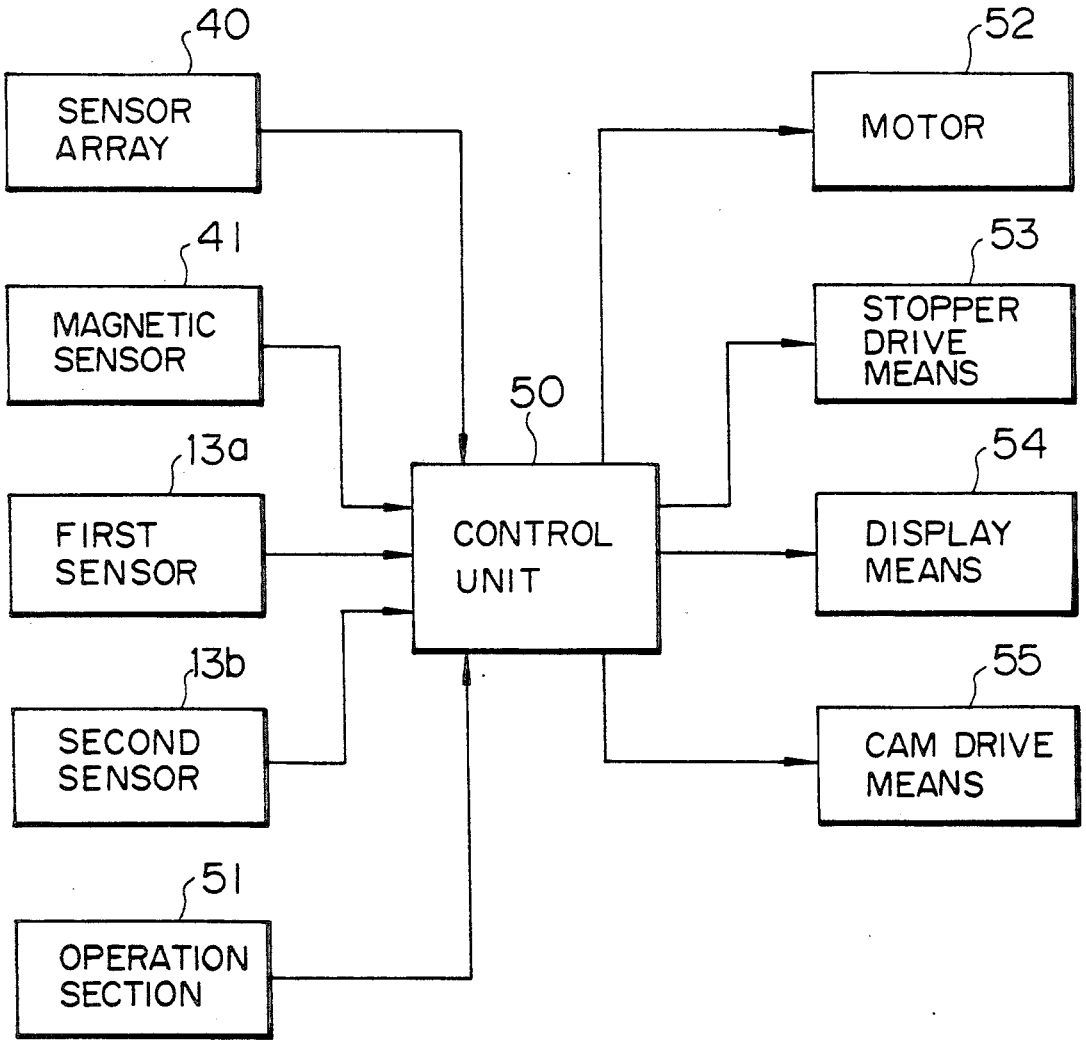
FIG. 4 is a block diagram showing a control system of a coin feeding apparatus which is an embodiment of the present invention.

FIG. 4 is a block diagram showing a control system of the coin feeding apparatus which is an embodiment of the present invention.

In FIG. 4, the detection signals from the sensor array 40 and the magnetic sensor 41 and the position detection signals which represent the position of the guide member 7 from the first and second sensors 13*a* and 13*b* are input to the control unit 50. Further, in accordance with an operator's instructions, instruction signals such as a start signal, a restart signal and the like are input from a operation section 51 to the control unit 50. The control unit 50 outputs, based upon these input signals, a drive signal to a motor 52 for rotating the rotatable disk 1 and driving the transporting belt 32, a stopper drive signal to a stopper drive means 53 for moving the stopper 42, display signals to a display means 54 for displaying information to the effect that an unacceptable coin C has been detected and the value and the number of deposited coins C in accordance with their denominations as occasion demands, and cam drive signals to a cam drive means 55 for rotating the cam shaft 11.

In the thus constituted coin feeding apparatus for the coin handling machine, when an operator deposits coins C through a coin deposit opening (not shown) and presses a start switch (not shown) provided in the operation section 51, a start signal is input from the operation section 51 to the control unit 50, whereby the control unit 50 drives a transporting means (not shown) to feed the coins C onto the rotatable disk 1. The coins C fed onto the rotatable disk 1 are fed in the clockwise direction along the inner circumference 3*a* of the guide ring member 3 by centrifugal force produced by the rotation of the rotatable disk 1 and after being separated one by one by the coin separation plate 6, they are fed one by one toward the inner face 7*a* of the guide member 7. Where the coins are being fed into the coin passage 4, since the cam follower 10 abuts against the cam lobe farthest from the cam shaft 11 of the cam 12 so that the guide member 7 is disposed at its first position, the inner face 7*a* of the guide member 7 is smoothly aligned with the inner circumference 3*a* of the guide ring member 3 and the upstream corner portion 7*d* thereof is positioned in the vicinity downstream of the predetermined portion 6*a* of the coin separation plate 6. Therefore, it is ensured that the coins C are fed one by one to the transporting belt 32, while being guided by the guide member 7 along the inner face 7*a* thereof. The coins C are further fed by the drive force of the transporting belt 32 and the rotating force of the rotating disk 1, while being held between the transporting belt 32 and the upper face of the rotatable disk 1, and abut against the guide roller 22. Although the guide roller 22 is rotated for smoothly feeding the coins C into the coin passage 4 when the coins abut against the guide roller 22, before the rotation of the guide roller 22 is started, a coin C abutting the guide roller 22 is temporarily stopped. Therefore, there is a probability of the following coin C colliding with it. However, in this embodiment, since the first guide rail 20 extends to inside of the periphery 1*a* of the rotatable disk 1 and the guide roller 22 is disposed upstream of the first guide rail 20, even if the preceding coin C and the following coin C collide with each other, they are fed toward the face 20*a* of the first guide rail 20 on the side of the coin passage 4 by the rotating force of the rotatable disk 1, whereby deviation of coins C from their desired transporting path can be prevented. As a result, the coins C are further fed along the face 20*a* of the first guide rail 20 on the side of the coin passage 4 by the transporting belt 32, their diameters and magnetic properties are detected by the sensor array 40 and the magnetic sensor 41 arranged along the face 20*a* of the first guide rail 20 on the side of the coin passage 4, their denominations, whether or not acceptable and the like are discriminated and their value is counted in accordance with their denominations by the control unit 50.

When the control unit 50 detects an unacceptable coin C based upon the input signals from the sensor array 40 and the magnetic sensor 41, it immediately stops the discrimination of the denominations of coins C and whether or not the coins C are acceptable and the counting of the value of deposited coins C, drives the stopper drive means 53 to cause the stopper 42 to project, thereby to prevent the unacceptable coin C from being further transported in the coin passage 4 and causes the display means 54 to display information showing that an unacceptable coin C was detected. When the information regarding the unacceptable coin C is displayed in the display means 54, an operator opens a cover (not shown) of the coin feeding apparatus and removes the unacceptable coin C. Then, he or she closes the cover and presses a restart switch (not shown) provided in the operation section 51. When the restart switch is pressed, a restart signal is input from the operating section 51 to the control unit 50. As a result, the control unit 50 drives the motor 52, thereby to cause it to reversely drive the transporting belt 32 and rotate counterclockwise and further drives the stopper drive means 53, thereby to cause it to retract the stopper 42 so that the upper edge thereof is positioned below the upper face of the coin passage 4. Simultaneously, the control unit 50 outputs a cam drive signal to the cam drive means 55, thereby to cause it to rotate the cam shaft 11 until the second sensor 13*b* detects the guide member 7 and, as shown in FIG. 3, to position the guide member 7 at its second position. As a result, the distance between the corner portion 7*c* of the terminal portion 7*b* of the guide member 7 and the tangential plane of the guide roller 22 lying parallel with the face 20*a* of the first guide rail 20 on the side of the coin passage 4 is set greater than the diameter of the largest coins C to be handled and the upstream corner portion 7*d* projects from the region downstream of the predetermined portion 6*a* of the coin separation plate 6 onto the rotatable disk 1 inside of coin separation plate 6.

Since in this situation, the following coins C which have been successively fed into the coin passage 4 after the unacceptable coin C and remain in the coin passage 4 are returned toward the rotatable disk 1, it is possible to prevent the following coins C from colliding with the terminal portion 7*b* of the guide member 7 without fail and to smoothly return the following coins C along the inner face 7*a* of the guide member 7 onto the rotatable disk 1 through the portion where the clearance between the lower edge of the coin separation plate 6 and the upper face of the rotatable disk 1 equals "d". Thus, when the control unit 50 detects that a predetermined time period has passed and judges that all the following coins C which remained in the coin passage 4 have been returned onto the rotatable disk 1, the control unit 50 outputs a cam drive signal to the cam drive means 55, thereby to cause it to rotate the cam shaft 11 until the first sensor 13*a* detects the guide member 7 and, as shown in FIG. 1, to return the guide member 7 to its first position, and, simultaneously, causes the motor 52 to rotate the rotatable disk 1 clockwise and to drive the transporting belt 32 so that the coins C are transported downwardly in the coin passage 4.

According to the above described embodiment, since the inner circumference 3*a* of the guide ring means 3 is disposed inside of the periphery 1*a* of the rotatable disk 1, where the coins C are fed into the coin handling machine, the guide member 7 is disposed at its first position where the inner face 7*a* thereof is smoothly aligned with the inner circumference 3*a* of the guide ring member 3, the distance between the periphery of the guide roller 22 and the corner portion 7*c* of the guide member 7 is slightly greater than the diameter of the largest coins C to be handled and the distance between the tangential plane of the guide roller 22 lying parallel with the face 20*a* of the first guide rail 20 on the side of the coin passage 4, and the corner portion 7*c* of the guide member 7 is slightly smaller than the diameter of the smallest coins C to be handled, the first guide rail 20 extends to inside of the periphery 1*a* of the rotatable disk 1 and the guide roller 22 is provided upstream of the first guide rail 20, it is possible to abut all coins C against the guide roller 22 and feed them into the coin passage 4, while being guided by the guide roller 22, and even if a coin is temporarily stopped by the guide roller 22 and the coin C stopped by the guide roller 22 and the following coin C collide with each other, since the coins C are transported along the first guide rail 20 without fail, it is possible to prevent the sensor array 40 and the magnetic sensor 41 from erroneously discriminating the coins C and erroneously counting the value thereof. Further, after the operator removes an unacceptable coin C detected by the sensor array 40 and the magnetic sensor 41 and prevented from being transported by the stopper 42, when the following coins C which have been successively fed into the coin passage 4 after the unacceptable coin C and remain in the coin passage 4 are returned onto the rotatable disk 1 by reversely driving the rotatable disk 1 and the transporting belt 32, since the guide member 7 is moved to its second position where the distance between the corner portion 7*c* of the terminal portion 7*b* thereof and the tangential plane of the guide roller 22 lying parallel with the face 20*a* of the first guide rail 20 on the side of the coin passage 4 is set greater than the diameter of the largest coins C to be handled and the upstream corner portion 7*d* of the guide member 7 is positioned so as to project into the region downstream of the predetermined portion 6*a* where the clearance between the lower edge of the coin separation plate 6 and the upper face of the rotatable disk 1 is equal to. "d", the following coins C are smoothly returned onto the rotatable disk 1 along the inner face 7*a* of the guide member 7, while being guided by the guide member 7, without colliding with the terminal portion 7*b* of the guide member 7, whereby it is possible to easily restart feeding coins C into the coin handling machine.

According to the present invention, it is possible to provide a coin feeding apparatus for a coin handling machine, which can prevent coins from being erroneously discriminated and the value of coins from being erroneously counted and easily restart the coin feeding operation even when an unacceptable coin is detected.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, although the transporting belt 32 extends upstream from the terminal portion 7*b* of the guide member 7, it is sufficient for the coins C to be transported by the transporting belt 32 so as to abut against the guide roller 22 without fail and for the transporting belt 32 to extend at least upstream of the guide roller 22.

Further, in the above described embodiment, although the face 20*a* of the first guide rail 20 on the side of the coin passage 4 is arranged in parallel with the transporting belt 32, it is possible for the distance between itself and the transporting belt 32 to be reduced toward the second pulley 31, thereby enhancing the tendency of coins C to be transported by the transporting belt 32 along the face 20*a* of the first guide rail 20 on the side of the coin passage 4.

Furthermore, in the above described embodiment, although the height of the upper face of the coin passage 4 is the same as that of the rotatable disk 1, it may be slightly lower than the height of the upper face of the rotatable disk 1.

Moreover, although the coin passage 4 downstream of the stopper 42 was not described with respect to the above described embodiment, it is possible to provide further a guide rail aligned with the first guide rail 20 so that the coins C will be transported along the face thereof on the side of the coin passage 4 and also to provide a coin collecting opening for collecting coins C or coin sorting openings for sorting coins C in accordance with their denomination by causing them to fall thereinto based upon their diameters.

Further, it should be noted that each means defined in the appended claims does not necessarily mean a physical means and that cases where the function of individual means can be accomplished by software fall within the scope of the present invention. In addition, the functions of two or more means defined in the appended claims may be accomplished by one physical means and the function of one means defined in the appended claims may be accomplished by two or more physical means in present invention.

We claim:

1. A coin feeding apparatus for a coin handling machine comprising a rotatable disk for receiving coins, guide ring means having a circular inner circumference disposed inside of an outer periphery of the rotatable disk for guiding by the inner circumference thereof coins received by the rotatable disk and moved toward the outer periphery of the rotatable disk by centrifugal force produced by the rotation of the rotatable disk, an opening in said guide ring a coin passage communicating with said opening and having a pair of first and second guide rail means and transporting belt means for transporting coins, the coins being transported along the first guide rail means disposed on the side of the rotatable disk, discriminating means for discriminating the denomination of coins and whether or not the coins are acceptable, counting means for counting the value of deposited coins, the discriminating means and the counting means being arranged along the first guide rail means of said coin passage, rotatable guide roller means disposed upstream of said first guide rail means, the first guide rail means extending onto the rotatable disk, said coin feeding apparatus for a coin handling machine further comprising guide means extending along the coin feed direction in the vicinity of said coin passage, said guide means being swingable between a first position where one face of the guide means is smoothly aligned with said inner circumference of said guide ring means and a second position where said face is not smoothly aligned with said inner circumference of said guide ring means, said guide means having a downstream corner portion at an end of said face, said portion being the pint of the guide means closet to the guide roller means when said guide means is in said first position, said first position being further characterized in that a first plane formed tangential to said inner circumference of said guide ring means at said downstream corner portion is spaced at a distance less than the diameter of the smallest diametered coin to be handled from a second plane lying along the first guide rail means, said second position being further characterized in that said downstream corner portion is located essentially in line with said second guide rail means such that the distance between said downstream corner portion and said guide roller means is larger than the largest diametered coin to be handled.

2. A coin feeding apparatus for a coin handling machine in accordance with claim 1 wherein an upstream end of said transporting belt means is disposed upstream of the opening and of the terminal portion of the guide means with respect to the rotating direction of the rotatable disk.

3. A coin feeding apparatus for a coin handling machine in accordance with claim 2 wherein there is further provided, upstream of said guide roller means, press roller means for pressing said transporting belt means onto the upper face of the coin passage.

4. A coin feeding apparatus for a coin handling machine in accordance with claim 1 wherein coin separation means is further provided upstream of the opening and such that a clearance between itself and an upper face of the rotatable disk is slightly greater than a thickness of the thickest coins to be handled and smaller than double the thickness of the thinnest coins to be handled, and an upstream corner portion of the guide means projects from the vicinity of an upstream end portion of the coin separation means onto the rotatable disk inside of the coin separation means when said guide means is disposed at its second position.

5. A coin feeding apparatus for a coin handling machine in accordance with claim 2 wherein coin separation means is further provided upstream of the opening and such that a clearance between itself and an upper face of the rotatable disk is slightly greater than a thickness of the thickest coins to be handled and smaller than double the thickness of the thinnest coins to be handled, and an upstream corner portion of the guide means projects from the vicinity of an upstream end portion of the coin separation means onto the rotatable disk inside of the coin separation means when said guide means is disposed at its second position.

6. A coin feeding apparatus for a coin handling machine in accordance with claim 3 wherein coin separation means is further provided upstream of the opening and such that a clearance between itself and an upper face of the rotatable disk is slightly greater than a thickness of the thickest coins to be handled and smaller than double the thickness of the thinnest coins to be handled, and an upstream corner portion of the guide means projects from the vicinity of an upstream end portion of the coin separation means onto the rotatable disk inside of the coin separation means when said guide means is disposed at its second position.

* * * * *